US005702630A

United States Patent [19]

Sasaki et al.

[11] Patent Number: 5,702,630

[45] Date of Patent: Dec. 30, 1997

[54] FLUID HAVING BOTH MAGNETIC AND ELECTRORHEOLOGICAL CHARACTERISTICS

[75] Inventors: Makoto Sasaki; Hisatake Sato, both of Yokohama, Japan

[73] Assignee: Nippon Oil Company, Ltd., Tokyo, Japan

[21] Appl. No.: 821,570

[22] Filed: Mar. 19, 1997

Related U.S. Application Data

[63] Continuation of Ser. No. 433,196, May 2, 1995, abandoned, which is a continuation-in-part of Ser. No. 90,276, Jul. 13, 1993, abandoned.

[30] Foreign Application Priority Data

Jul. 16, 1992 [JP] Japan ..... 4-210655

[51] Int. Cl.[6] ..... H01F 1/44

[52] U.S. Cl. ..... 252/62.52; 252/62.51; 252/62.55; 252/62.56; 252/74

[58] Field of Search ..... 252/62.51, 62.52, 252/62.55, 62.56, 74; 428/329, 403, 404, 900, 321, 405; 427/213.3, 226, 376.2, 376.3, 376.4, 376.5, 376.7, 376.8, 372.2

[56] References Cited

U.S. PATENT DOCUMENTS

| | | | |
|---|---|---|---|
| 2,452,529 | 10/1948 | Snoek . | |
| 2,661,596 | 12/1953 | Winslow . | |
| 3,047,507 | 7/1962 | Winslow . | |
| 3,228,881 | 1/1966 | Thomas . | |
| 3,385,793 | 5/1968 | Klass et al. . | |
| 3,854,993 | 12/1974 | Harris et al. | 333/1.1 |
| 3,948,785 | 4/1976 | Berchtold | 252/62.62 |
| 4,356,098 | 10/1982 | Chagnon . | |
| 4,937,208 | 6/1990 | Yamamoto | 501/12 |
| 4,946,623 | 8/1990 | Tabony . | |
| 4,951,675 | 8/1990 | Groman et al. . | |
| 5,039,559 | 8/1991 | Sang et al. | 427/213.3 |
| 5,110,598 | 5/1992 | Kwan et al. . | |
| 5,204,096 | 4/1993 | Neurath et al. . | |
| 5,217,804 | 6/1993 | James et al. | 428/329 |
| 5,240,626 | 8/1993 | Thakur et al. . | |
| 5,368,887 | 11/1994 | Hoshino et al. | 427/226 |
| 5,507,967 | 4/1996 | Jujita et al. | 252/62.52 |

FOREIGN PATENT DOCUMENTS

| | | |
|---|---|---|
| 0 478 034 | 4/1992 | European Pat. Off. . |
| 0 566 931 | 10/1993 | European Pat. Off. . |
| 51-33783 | 3/1976 | Japan . |
| 51-44579 | 4/1976 | Japan . |
| 53-93186 | 8/1978 | Japan . |
| 58-179259 | 10/1983 | Japan . |
| 61-44998 | 3/1986 | Japan . |
| 62-95397 | 5/1987 | Japan . |
| 4-261496 | 9/1992 | Japan . |
| 1076754 | 7/1967 | United Kingdom . |

OTHER PUBLICATIONS

Ullmann's Encyclopedia of Industrial Chemistry, vol. A 14, 1989, pp. 241, 248–250 and 641–644 (Month Unknown).

Derwent Abstract of JP–A–4 261 496 (Toyota Jidosha K.K.) (Sep. 17, 1992).

Derwent Abstract of SU–A–925 520 (Churkin) (May 7, 1982).

Iizuka, J. Appl. Polymer Sci: Appl. Polymer Symposium, 41, pp. 131–147, (1985) (Month Unknown).

*Primary Examiner*—Alan Diamond

*Attorney, Agent, or Firm*—Armstrong, Westerman, Hattori, McLeland & Naughton

[57] ABSTRACT

A fluid having both magnetic and electrorheological characteristics, which comprises composite particles of ferromagnetic particles and a metallic oxide prepared by a sol-gel reaction of a metal alkoxide in the presence of the ferromagnetic particles and a solvent and a process for producing the same.

4 Claims, No Drawings

FLUID HAVING BOTH MAGNETIC AND ELECTRORHEOLOGICAL CHARACTERISTICS

This application is a continuation of application Ser. No. 08/433,196 filed May 2, 1995, now abandoned; which is a continuation-in-part of Ser. No. 08/090,276 filed Jul. 13, 1993 now abandoned.

BACKGROUND OF THE INVENTION

1) Field of the Invention

The present invention relates to a fluid having both a characteristic of magnetic fluid susceptible to a magnetic field and a characteristic of an electrorheological fluid whose viscosity can increase with an applied electric field, and particularly to a fluid capable of outputting a large force at a high response speed and a process for producing the fluid.

2) Prior Art

A magnetic fluid is a colloidal solution, which is a uniform dispersion of ferromagnetic particles in a solvent, and when a magnet is provided near the magnetic fluid, the entire fluid is attracted towards the magnet and behaves as if the entire fluid is apparently charged with a magnetism.

Furthermore, the magnetic fluid has such a characteristic that a large force can be induced in the magnetic fluid with an applied magnetic field. By virtue of this characteristic, the magnetic fluid is utilized for rotating shaft sealing, and further application to dampers, actuators, gravity separation, jet printers, etc. can be expected.

A typical process for preparing a magnetic fluid is a chemical coprecipitation process disclosed in JP-A 51-44579, where an aqueous slurry of magnetic particles prepared from an aqueous solution of ferrous sulfate and an aqueous solution of ferric sulfate is admixed with a surfactant, followed by water washing, drying and dispersion into an organic solvent, thereby preparing a magnetic fluid.

An electrorheological fluid, on the other hand, is a suspension of inorganic or polymeric particles in an electrically insulating liquid, whose viscosity can be rapidly and reversibly changed from a liquid state to a plastic state or to a solid state or vice versa upon application of an electric field thereto. A high response speed is one of the characteristics.

As dispersed particles, those whose surfaces are readily depolarizable under an electric field are usually used. For example, as inorganic dispersed particles, silica is disclosed in U.S. Pat. No. 3,047,507, British Patent No. 1,076,754 and JP-A 61-44998, and zeolite is disclosed in JP-A 62-95397. As polymeric dispersed particles, arginic acid, glucose having carboxyl groups and glucose having sulfone groups are disclosed in JP-A 51-33783; polyacrylic acid cross-linked with divinylbenzene is disclosed in JP-A 53-93186; and resol-type phenol resin is disclosed in JP-A 58-179259.

As an electrically insulating liquid, mineral oil, silicone oil, fluorohydrocarbon-based oil, halogenated aromatic oil, etc. are known.

It is preferable from the viewpoint of higher electrorheological effect that water is adsorbed on the surfaces of dispersed particles. In most cases, the electrorheological fluid contains a small amount of water Mechanism of increase in the viscosity of an electrorheological fluid with an applied electric field can be clarified on the basis of the electric double layer theory. That is, an electric double layer is formed on the surfaces of dispersed particles of an electrorheological fluid, and when there is no application of an electric field, dispersed particles repulse one another on the surfaces and are never in a particle alignment structure. When an electric field .is applied thereto, on the other hand, an electrical deviation occurs in the electrical double layers on the surfaces of dispersed particles, and the dispersed particles are electrostatically aligned to one another, thereby forming bridges of dispersed particles. Thus, the viscosity of the fluid is increased, and sometimes the fluid is solidified. The water contained in the fluid can promote formation of the electrical double layer.

Application of the electrorheological fluid to engine mounts, shock absorbers, clutches, etc., can be expected.

However, the magnetic fluid still has such problems that neither high permeability nor higher response speed as aims to a quick response is obtainable. When it is used as a seal, a low sealability is also one of the problems. These problems are obstacles to practical applications. The electrorheological fluid, still has such a problem that the torque induced upon application of an electrical field is so small that no larger force can be obtained.

SUMMARY OF THE INVENTION

An object of the present invention is to provide a fluid capable of producing a large torque at a high response speed and a process for producing the fluid.

As a result of extensive studies to solve the problems, the present inventors have found that a fluid containing both a magnetic field-susceptible component and an electric field-susceptible component, particularly a fluid containing composite particles of ferromagnetic particles and a metallic oxide prepared by a sol-gel reaction in the presence of the ferromagnetic particles can solve the problems and have established the present invention.

That is, the present invention provides a fluid having both magnetic and electrorheological characteristics, which comprises composite particles of ferromagnetic particles and a metallic oxide prepared by a sol-gel reaction of a metal alkoxide in the presence of the ferromagnetic particles and a solvent.

The present invention provides also a process for producing a fluid having both magnetic and electrorheological characteristics, which comprises:

adding a metal alkoxide solution to ferromagnetic particles to mix, then conducting a sol-gel reaction to change the metal alkoxide to a metallic oxide, thereby preparing composite particles of the ferromagnetic particles and the metallic oxide, conducting degasification and drying for the composite particles, then adding a solvent to thus obtained composite particles to mix, and thereby obtaining the fluid.

DETAILED DESCRIPTION OF THE INVENTION

The present invention will be described in detail below.

The term "susceptible to a magnetic field" or "a magnetic field-susceptible" used herein means "a property attractive to, for example, a magnetic". Magnetic field-susceptible components include magnetic particles, particularly ferromagnetic particles, more specifically magnetic particles of oxides such as magnetite, manganese ferrite, barium ferrite, etc.; magnetic particles of metals such as iron, cobalt, nickel, permalloy, etc.; particles of iron nitride, etc.

Magnetic particles preferably have particle sizes of 0.003 to 200 μm, and particularly hard magnetic particles preferably have particle sizes of 0.003 to 0.5 μm and soft magnetic particles preferably have particle sizes of 0.1 to 200 μm. In case of obtaining a particularly very large force, soft magnetic particles having particle sizes of 1 to 100 μm are preferable. Below 0.003 μm, the particles fail to show a magnetism, whereas above 200 μm the dispersibility in the fluid is much deteriorated.

The term "susceptible to an electric field" or "an electric field-susceptible" used herein means "a property to increase the viscosity of a fluid upon application of an electric field". Electric field-susceptible components include known dispersed particles used in the electrorheological fluid, more specifically particles of silica, zeolite, titanium, ion exchange resin, starch, gelatin, cellulose, arginic acid, glucose derivatives, sodium polyacrylate, resol-type phenol resin, polyaniline, sulfonated polystyrene, barium titanate, carbon, etc. The dispersed particles have particle sizes of 0.01 to 500 μm, preferably 1.0 to 100 μm. Below 0.01 μm, no more satisfactory electrorheological effect can be obtained, whereas above 500 μm no more satisfactory dispersion stability can be obtained.

Combination form of the magnetic field-susceptible component and the electric field-susceptible component includes dispersion or solution of the respective components separately in a solvent, or particles that integrate these two component, that is, composite particles, when the electric field-susceptible component is in the form of dispersed particles. Composite particles are preferable for obtaining a higher response speed and a larger torque.

The composite particles for use in the present invention are composed of ferromagnetic particles and a metallic oxide prepared by a sol-gel reaction of a metal alkoxide in the presence of the ferromagnetic particles.

The term "sol-gel reaction" indicates the reaction that "an organic or inorganic compound" is dissolved in a solvent including water and alcohol and a polymer or fine particles are produced by hydrolysis, polymerization near room temperature to form a sol. The sol is changed to a gel by further progress of the reaction. The thus obtained gel is dried. Generally, the materials prepared by a sol-gel process include gels, glasses, ceramics, composite substances etc ("Sol-gel process" M. Yamane, Sol-Gel Ho Kankokai, June 1992).

The most common sol-gel processes employ alkoxides of elements such as silicon, boron, titanium, and aluminum. In alcohol-water solution, the alkoxide groups are removed stepwise by hydrolysis under acidic or basic catalysis and replaced by hydroxyl groups, which then form —M—O—M— linkages. Thus, branched polymeric chains grow and interconnect, as illustrated below for a silicate sol. Gelation eventually occurs as the growing polymers link together to form a network that spans the entire solution volume. At this point (the gel point), both the viscosity and the elastic modulus increase rapidly.

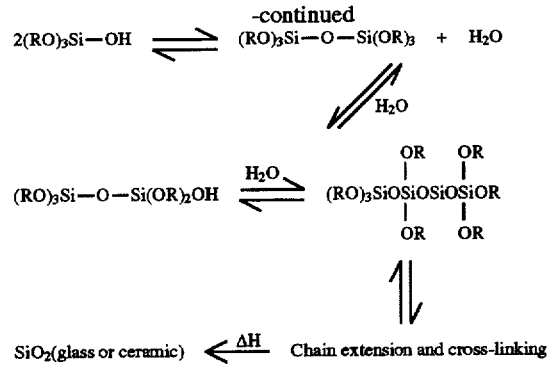

(Ullmann's Encyclopedia of Industrial Chemistry, P248, Vol. A14, 1989)

The metal alkoxides for use in the present invention, for example, include $Si(OCH_3)_4$, $Si(OC_2H_5)_4$, $Si(OC_3H_7)_4$, $Si(OC_4H_9)_4$, $Ti(OCH_3)_4$, $Ti(OC_2H_5)_4$, $Ti(OC_3H_7)_4$, $Ti(OC_4H_9)_4$, $Zr(OCH_3)_4$, $Zr(OC_2H_5)_4$, $Zr(OC_3H_7)_4$, $Zr(OC_4H_9)_4$, $Al(OCH_3)_3$, $Al(OC_2H_5)_3$, $Al(OC_3H_7)_3$, $Al(OC_4H_9)_3$, $Ba(OC_2H_5)_2$, $Zn(OC_2H_5)_2$, $B(OCH_3)_3$, $Ga(OC_2H_5)_3$, $Ge(OC_2H_5)_4$, $Pb(OC_2H_5)_4$, $Ta(OC_3H_7)_5$, and $W(OC_2H_5)_6$, etc. Particularly, silicon alkoxide and titanium alkoxide are preferable.

The composite particles of ferromagnetic particles and a metallic oxide are produced by the following process.

That is, a metal alkoxide solution is added to ferromagnetic particles to mix. The solvent for use in the metal alkoxide solution, for example, includes a mixture of alcohol having 1 to 6 carbon atoms and water.

The amounts of ferromagnetic particles and metal alkoxide are preferably 98–2 wt. % and 2–98 wt. %, more preferably 95–8 wt. % and 5–92 wt. %. When metal alkoxide is below 2 wt. % a fluid dispersed composite particles being obtained by a sol-gel process provide no electrorheological effect, whereas above 98 wt. % only the electrorheological effect can be obtained.

In the most common sol-gel processes, acid or base is employed as a catalyst for condensation reaction. Also in the present invention, acid or base is employed as a catalyst for condensation reaction. However, since titanium alkoxides have large reactivity, exceptionally, the condensation reaction proceeds in the absence of a catalyst.

Then, a sol-gel reaction is conducted to change the metal alkoxide to a metallic oxide. It is preferable to conduct the sol-gel reaction near room temperature for about 2 to 5 hours.

Thereby, composite particles of the ferromagnetic particles and the metallic oxide are prepared. In the composite particles, the surfaces of the ferromagnetic particles are coated with the metallic oxide or the ferromagnetic particles are dispersed into the metallic oxide.

Degasification and drying are conducted for thus obtained composite particles. It is preferable to conduct degasification and drying under a reduced pressure.

A solvent is added to thus prepared composite particles to produce a fluid. A torque being generated by using such fluid containing composite particles of ferromagnetic particles and metallic oxide prepared by a sol-gel reaction and a solvent is larger than that being generated by using a fluid wherein two species of ferromagnetic particles and particles having the electrorheological effect have been dispersed into a solvent.

In the foregoing procedures, raw materials for the ferromagnetic particles, for example, sulfates, carbonyl compounds, etc., can be used instead of the ferromagnetic particles, to form ferromagnetic particles in the course of preparing composite particles.

In the present invention, the amounts of the magnetic field-susceptible component and the electric field-susceptible component in the composite are preferably 99.8–3 wt. % and 0.2–97 wt. %, more preferably 99–10 wt. % and 1–90 wt. %. When the electric field-susceptible component is below 0.2 wt. %, no electrorheological effect can be obtained, whereas above 97 wt. % only the electrorheological effect can be obtained.

When the electric field-susceptible component is dispersed particles of, for example, silica or the like, the amounts of the magnetic field-susceptible component and the electric field-susceptible component in the composite are preferably 99–10 wt. % and –90 wt. %, more preferably 97–30 wt. % and 3–70 wt. %. When the electric field-susceptible component is less than 1 wt. %, no electrorheological effect can be obtained, whereas above 90 wt. % only the electrorheological effect can be obtained.

The solvent for use in the present invention includes, ior example, polar solvents such as dioxane, tetrahydrofuran, cresol, etc.; chlorinated solvents such as methylene chloride, chloroform, chlorobenzene, o-dichlorobenzene, etc.; hydrocarbon-based oils such as mineral oil, alkylbenzene, alkylnaphthalene, poly-α-olefin, etc.; ester-based oils such as dibutyl phthalate, dioctyl phthalate, dibutyl sebacate, etc.; ether-based oils such as oligophenylene oxide, etc.; silicone oils; and fluorocarbon-based oils, among which hydrocarbon-based oils and ester-based oils or particularly preferable from the viewpoints of less toxicity and less electric current passage. These oils can be used in mixture.

The boiling point of the solvent is preferably 150° C. or higher under the atmospheric pressure, more preferably 150° C. to 700° C., most preferably 200° to 650° C. Below 150° C., the solvent is more vaporizable, and thus this is not preferable. The viscosity is preferably 1 to 500 cSt at 40° C., more preferably 5 to 300 cSt at 40° C.

In the present invention, the amounts of the sum total of the magnetic field-susceptible component and the electric field-susceptible component and of the solvent is preferably 1–90 wt. % and 99–10 wt. %, more preferably 10–80 wt. % and 90–20 wt. %. When the solvent is less than 10 wt. %, the viscosity of the fluid will be increased, thereby deteriorating the function as a fluid, whereas above 99 wt. %, neither magnetic nor electrorheological effect can be obtained.

When the electric field-susceptible component is dispersed particles of, for example, silica or the like, the amounts of the sum total of the magnetic iield-susceptible component and the electric field-susceptible component, and of the solvent are preferably 1–90 wt. % and 99–10 wt. %, more preferably 20–80 wt. % and 80–20 wt. %. When the solvent is less than 10 wt. %, the viscosity of the fluid will be increased, thereby deteriorating the function as a fluid, whereas above 99 wt. % neither magnetic nor electrorheological effect can be obtained.

In the present invention, addition of a small amount of water can promote an electrorheological effect in some cases. An amount of water to be added is preferably not more than 30 wt. % on the basis of the electric field-susceptible component.

In the present invention it is possible to add additives such as a surfactant to the fluid within such a range as not to deteriorate the effect of the present invention.

In the present invention, both magnetic field and electric field can be applied at the same time with constant intensities, or while changing the intensities in accordance with changes in the necessary torque, or one of the magnetic field and the electric field can be applied continuously with a constant intensity while changing the applied intensity of other field in accordance with changes in the necessary torque. It is particularly preferable to apply a magnetic field with a constant intensity to obtain a torque to some degree, and change applied intensity of an electric field by making fine adjustment of the necessary torque.

The present fluid can be applied to engine mounts, shock-damping apparatuses such as shock absorbers, etc., clutches, torque converters, brake systems, valves, dampers, suspensions, actuators, vibrators, inject printers, seals, gravity separation, bearings, polishing, control valves, vibration-preventing materials, etc.

PREFERRED EMBODIMENTS OF THE INVENTION

The present invention will be explained in detail below, referring to Examples, which will be never limitative of the present invention.

Example 1

20 g of soft magnetic iron particles having particle sizes of 3 μm was added to a solution consisting of 60 g of tetraethoxysilane, 55 g of ethanol and 20 g of deionized water, and then 8 cc of 20 wt. % ammonia water was further added thereto with stirring. Immediately after the addition, particles were formed, and the reaction was continuously carried out at 80° C. for 3 hours thereafter to complete the sol-gel reaction to form silica.

After the end of the reaction, degasification and drying were carried out at 100° C./2 mmHg for 4 hours to obtain composite particles (1-1) of silica and soft magnetic iron particles. The composite particles (1—1) contained 54 wt. % of iron.

Then, 30 g of the composite particles (1-1) was dispersed into 70 g of silicone oil KF-96 (trademark of a product made by Shinetsu Silicone K.K., Japan) having a viscosity of 20 cSt at 25° C. , and 5 wt. % of water was added thereto on the basis of the composite particles (1-1) to prepare a fluid (1-2). The fluid (1-2) had a saturation magnetization of 390 Gauss and it was found that the fluid (1-2) was attracted to a magnet.

The fluid (1-2) had a saturation magnetizaion of 410 Gauss, and it was found that the fluid (1-2) was attracted to a magnet.

Then, a high voltage-applicable test provided with two electrode each having an area of 400 $mm^2$ and being faced to each other at a clearance of 1 mm, and with an electromagnet on both electrodes was placed sideways, and then the fluid (1-2) was filled into the cell to determine magnetic and electrorheological characteristics, while determining torques by changing the position of the upper electrode in the horizontal direction. The response speed was determined with an oscillograph by measuring a delay in a torque following application of either magnetic or electric field or both.

Under no application of magnetic and electric fields, the fluid (1-2) had a torque of 33 g·cm. When only a magnetic field of 1,500 Oe was applied to the fluid (1-2), a torque of 236 g·cm and a response speed of 0.39 sec. were obtained. When only an electric field of 3 kV/mm was applied to the fluid (1-2), a torque of 327 g. cm and a response speed of 0.02 sec. were obtained. It was found that the fluid (1-2) had both magnetic and electrorheological effects. When a magnetic field of 1,500 Oe and an electric field of 3 kV/mm were applied to the fluid (1-2) at the same time, a torque of 544 g·cm and a response speed of 0.08 sec. were obtained.

Example 2

50 g of tetrabutoxytitanium, 10 g of ethanol and 6 g of water were added to a solution containing 25 g of soft magnetic iron particles dispersed into 200 g of xylene with stirring, and then the sol-gel reaction for the production of titanium oxide was continuously conducted at room temperature for 3 hours to coat surfaces of the soft magnetic iron particles with titanium oxide. After the completion of the reaction, the particles were recovered by filtration, and then degasification and drying were carried out at 100° C./ 2 mmHg for 4 hours to obtain composite particles (2-1) of titanium oxide and soft magnetic iron particles. The composite particles (2-1) contained 67 % by weight of iron.

Then, 30 g of the composite particles (2-1) was dispersed into 70 g of silicone oil KF-96 (trademark of a product made by Shinetsu Silicone K.K., Japan) having a viscosity of 20 cSt at 25° C. to prepare a fluid (2-2). The fluid (2-2) had a saturation magnetization of 510 Gauss and it was found that the fluid (2-2) was attracted to a magnet.

Then, magnetic and electrorheological characteristics of the fluid (2-2) were investigated in the same manner as in Example 1.

The fluid (2-2) had a torque of 30 g·cm under no application of both magnetic and electric fields. When only a magnetic field of 1,500 Oe was applied to the fluid (2-2), the torque was 302 g·cm and the response speed was 0.43 sec.

When only an electric field of 3 kV/mm was applied to the fluid (2-2), the torque was 318 g·cm and the response speed was 0.02 sec.

Thus, it was found that the fluid (2-2) had both magnetic and electrorheological effects.

When a magnetic field of 1,500 Oe and an electric field of 3 kV/mm were applied to the fluid (2-2) at the same time, the torque was 726 g·cm and the response speed was 0.07 sec.

Compartive Example 1

16.5 g of soft magnetic iron particles having particles sizes of 3μm and 13.5 g of silica particles having particle sizes of 10μm were dispersed into 70 g of silicone oil KF-96 (trademark of a product made by Shinetsu Silicone K.K., Japan) having a viscosity of 20 cSt at 25° C., and 5% by weight of water was added thereto on the basis of the silica particles to prepare a fluid (3-1). The fluid (3-1) had a saturation magnetization of 205 Gauss and it was found that the fluid (3-1) was attracted to a magnet.

Then, magnetic and electrorheological characteristics were determined in the same manner as in Example 1.

The fluid (3-1) had a torque of 31 g·cm under no application of both magnetic and electric fields. When only a magnetic field of 1,500 Oe was applied to the fluid (3-1), the torque was 78 g·cm and the response speed was 0.33 sec.

When only an electric field of 3 kV/mm was applied to the fluid (3-1), the torque was 92 g·cm and the response speed was 0.08 sec. Thus, it was found that the fluid (3-1) had both magnetic and electrorheological effects.

When a magnetic iield of 1,500 Oe and an electric field of 3 kV/mm were applied to the fluid (3-1) at the same time, the torque was 101 g·cm and the response speed was 0.28 sec.

What is claimed is:

1. A fluid having both magnetic and electrorheological characteristics, consisting essentially of an insulating liquid having stably dispersed therein ferromagnetic particles of manganese ferrite, barium ferrite, iron, nickel, permalloy or iron nitride, having a particle size of 0.003 to 200 μm and coated with a metallic oxide, said metallic oxide having been prepared by a sol-gel reaction of 2–98 wt % of a metal alkoxide in the presence of 98–2 wt % of the ferromagnetic particles.

2. A fluid having both magnetic and electrorheological characteristics according to claim 1, wherein the metal alkoxide is a silicon alkoxide or a titanium alkoxide.

3. A process for producing a fluid having both magnetic and electrorheological characteristics, which comprises:

mixing an aqueous alcohol solution containing 2–98 wt % of a metal alkoxide with 98–2 wt % of ferromagnetic particles of magnetite, manganese ferrite, barium ferrite, iron, nickel, permalloy or iron nitride having a particle size of 0.003 to 200 μm, effecting a sol-gel reaction to change the metal alkoxide to a metallic oxide thereby coating the ferromagnetic particles with the metallic oxide, separating the coated ferromagnetic particles from the solution, degasifying and drying the coated ferromagnetic particles, and dispersing the coated ferromagnetic particles in an insulating liquid.

4. A process according to claim 3, wherein the metal alkoxide is a silicon alkoxide or a titanium alkoxide.

* * * * *